United States Patent [19]

Price, II

[11] 4,336,899

[45] Jun. 29, 1982

[54] CARRYING SLING

[76] Inventor: Carroll D. Price, II, 11821 SW. 104 Ct., Miami, Fla. 33176

[21] Appl. No.: 210,017

[22] Filed: Nov. 24, 1980

[51] Int. Cl.[3] ..... A45F 5/00

[52] U.S. Cl. ..... 224/202; 294/74

[58] Field of Search ..... 224/202, 211, 149, 251, 224/257, 258; 220/3, 69, 94 R, 85 H, 85 K; 294/78 R, 74

[56] References Cited

U.S. PATENT DOCUMENTS

| | | | |
|---|---|---|---|
| 2,915,233 | 12/1959 | Moomaw | 224/202 X |
| 3,279,663 | 10/1966 | Torres | 224/202 X |
| 3,310,333 | 3/1967 | Hutson | 294/74 X |
| 3,592,502 | 7/1971 | Bolliger | 294/74 |
| 3,876,125 | 4/1975 | Emmert | 224/202 X |

FOREIGN PATENT DOCUMENTS

| | | | |
|---|---|---|---|
| 2630271 | 1/1978 | Fed. Rep. of Germany | 224/202 |

*Primary Examiner*—Steven M. Pollard

*Attorney, Agent, or Firm*—John Cyril Malloy

[57] ABSTRACT

A carrying sling for a generally cylindrical shaped scuba tank of the type which has an axially projecting valve control at one end and which has a closed lower end and wherein the carrying sling is composed of an end boot to nest about the lower end of the tank and a flexible strap with one end connected to the boot or end cup and the other end having a ring about it to connect over the extending valve control at the other end of the tank, so that the strap may be utilized to carry the scuba tank conveniently.

9 Claims, 4 Drawing Figures

CARRYING SLING

FIELD OF THE INVENTION

This invention relates to slings and, more particularly, to a carrying sling sized for companionately receipt of a scuba tank for use in carrying a scuba tank.

BACKGROUND OF THE INVENTION

In the past there have been numerous types of slings such as that disclosed in U.S. Pat. No. 3,310,333 which is of a device for carrying cargo externally of a hovering aircraft, and U.S. Pat. No. 3,592,502 which is of a device for carrying relatively heavy loads.

This invention is of a particular type of sling which is sized and shaped for companionate engagement with a conventional scuba tank for use in handling the same conveniently, which, in the past, has been rather awkward to those who have used them.

OBJECTS OF THE INVENTION

It is an object of this invention to provide an improved sling for use in combination with a scuba tank and wherein the sling is adapted for easy connection to and separation from the scuba tank and, while connected, is adapted for convenient handling of the scuba tank.

It is another object of this invention to provide a carrying sling for a scuba tank of a predetermined height having an upper rounded lower end zone with an axially projecting valve control and a closed lower end, which end is of predetermined diameter, and wherein the sling is composed of an end cup or boot sized to nest about the lower end of the tank and from which boot there extends a radially extending portion for hooked-up relation with one end of an adjustable flexible or pliable strap which has an upper end provided with a ring to be received over the valve control so that, the sling may be utilized for carrying the scuba tank.

In accordance with these and other objects, some of which are more expressly set forth herein and described more fully in the specification and claims which follow, the instant invention will now be described with reference to the accompanying drawings in which:

DESCRIPTION OF THE PREFERRED EMBODIMENT

Figure 1:
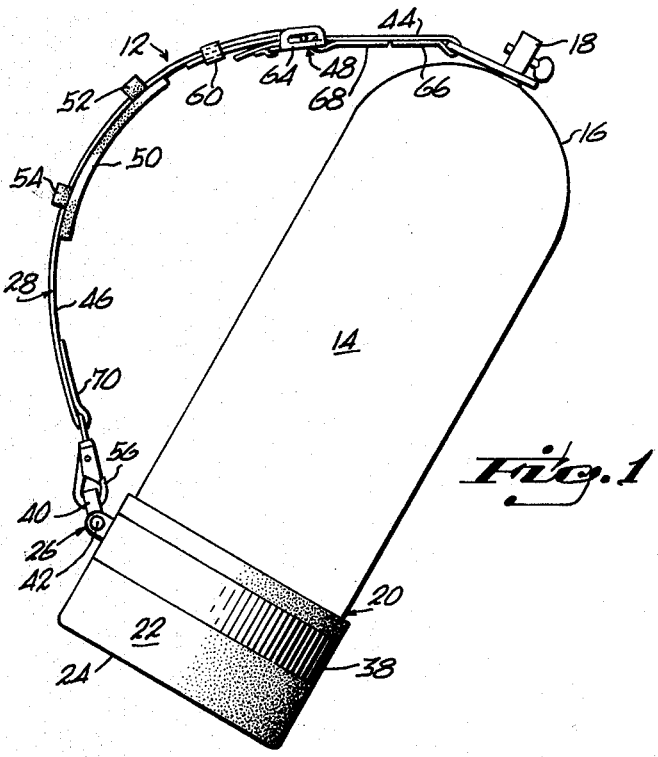
FIG. 1 is a perspective view of a scuba tank in combination with the carrying sling.

Referring to the drawings wherein like reference characters designate like or corresponding parts throughout the several views and referring particularly to FIG. 1, it is seen that the carrying sling is designated by the numeral 12. It is for a generally cylindrically shaped scuba tank 14 which is of a predetermined height conventionally used. As is standard, it has an upper ordinarily rounded end zone 16 from which there is an axially projecting valve 18 to control flow from the tank and which valve means is designated by the numeral 18. The lower end is closed and is of a predetermined diameter. The sling 12 will now be described, it being composed generally of an end cup 22 and a carrying strap 28.

The end cup has a cylindrical side wall 38 sized to nest about the lower end of the tank and this wall is spanned by a floor 24 to underlay the tank end. The end cup includes a radially extending portion 26 to connect to one end of the carrying strap.

The flexible strap for carrying the tank is designated by the numeral 28 and it has an upper end designated by the numeral 30 and a lower end designated by the numeral 32. It is of a length greater than the predetermined height of the tank and is adjustable in length.

Means 34 on the lower end of this strap are provided to connect to the radially extending portion of the end cup and, at the upper end of the carrying strap, a ring 36 is provided which is sized for passage over the projecting valve means.

In use, the lower end of the tank is adapted to be received in the end cup and the ring means are adapted to connect about the projecting valve means so that the strap may be used as a carrying sling for the scuba tank.

Figure 2:
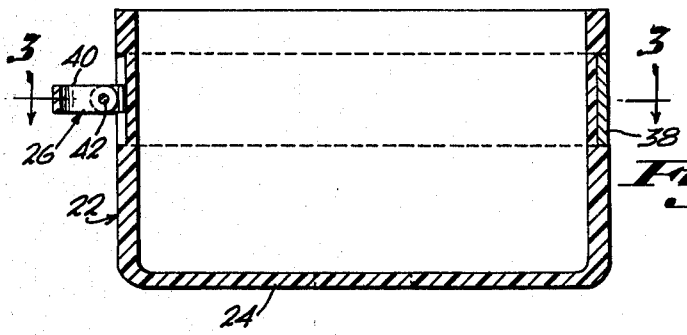
FIG. 2 is a vertical cross sectional view of the lower portion of the end cup shown in FIG. 1.
Figure 3:
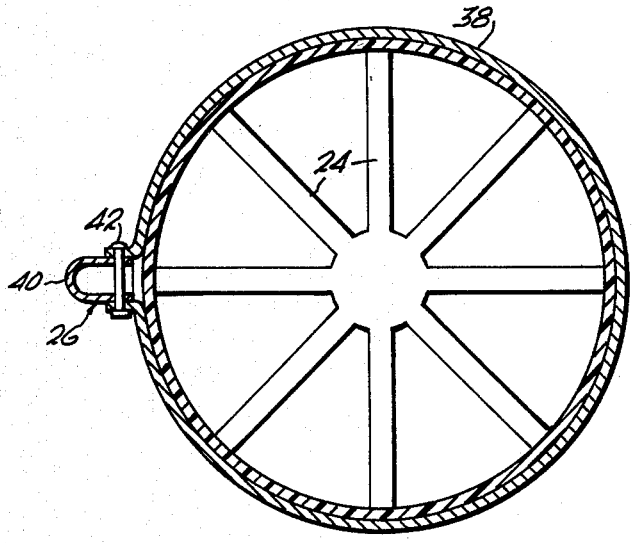
FIG. 3 is a view in cross section taken on the plane indicated by line 3—3 of FIG. 1 and looking in the direction of the arrows.
Figure 4:
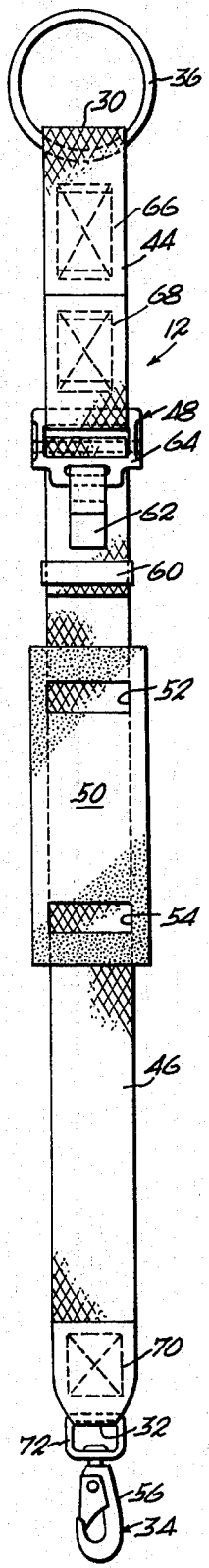
FIG. 4 is a vertical view illustrating a preferred construction of the strap utilized in the carrying sling.

In the preferred embodiment, as best seen in FIG. 3, the floor of the end cup comprises an openwork or spider in which radially projecting portions extend from the central zone of juncture. Preferably the end cup is of a rigid plastic material. As best seen in FIG. 2, an annular recess about the end cup nests the ring which is part of the side wall 38 in circumposed relation about the end cup and the ends of the ring are outturned, see FIG. 3, for connection of a U-shaped member 40 for hooked-up engagement with the hook 56 at the bottom of the strap, see FIG. 4. Preferably the U-shaped member is pivotally connected by means of the pivot means or pin 42 so that it is swingable from the position shown in FIG. 3 to the attitude shown in FIG. 1, the inner ends of the U-shaped member being rounded to accommodate this movement. The strap shown in FIG. 4, which is adjustable, preferably is composed of a first and a second length 44 and 46 which are connected together by an adjustment means generally designated by the numeral 48 and which is in the form of the buckle 64 of the conventional type, such as that customarily found on the seat belts of automobiles and aircraft. Additionally, a pad is provided on the strap, such as on the length 46 and, to this end, the pad which is of cushiony material and which is designated by the numeral 50 is provided with a loop at opposite ends, such as 52 and 54 through which the strap is threaded for adjustable movement of the pad along the length to a suitable location, such as for carrying over the shoulder of a user. Preferably the strap is of nylon material with the hook connected to the end 32 by means of a loop or a link 72 and with the end 32 being folded back upon itself and stitched as indicated by the numeral 70. Also, as indicated by the numerals 66 and 68 the upper end which is of a predetermined length is of a fixed overall length. The strap is conventional in many respects; however, it will be appreciated that in adjustment, the free end will be preferably captivated within the loop 60 about the strap so that it is adjustable along the length of it and, a keeper 62 may be provided to maintain the adjustment once determined.

It is thus seen that there has been provided an adjustable strap carrying sling for use with scuba tanks particularly wherein a clip or hook is provided at one end and a metal ring is provided at the other end of an adjustable strap. Conventionally the end cup or boot is of a diameter of about 7⅜ inch and in the preferred embodiment, the ring about the end cup is of about 1½ inches of axial length and located about ⅝ inch from the upper end with the overall height of the end cup being preferably about 4½ inches. In a preferred embodiment, the loop fastener may be embedded about the exterior of the end cup or, as shown, it may be recessed or embedded within the plastic of the end cup. The adjustable strap and the associated reinforced compressed air cylinder support cup or boot enable an individual to safely and easily carry a compressed air cylinder by hand or suspended from the shoulder. The strap by reason of its adjustment can be utilized as a handle to facilitate the carrying of a cylinder by hand or from a sling permitting the user to carry a cylinder under the arm with the weight of the cylinder suspended over the shoulder via the strap. Carrying a cylinder via the shoulder frees both hands of the user for other purposes. The adjustable strap is constructed of heavy duty material, preferably nylon webbing so as to withstand substantial weight and extremes of weather and temperature. Preferably the metal ring at the end of the strap is of corrosion-resistant character, such as brass, and is permanently attached to one end of the strap. It is of sufficient diameter to slip over the valve control or valve means located at the top of a conventional compressed air cylinder. The clip or hook means at the lower end of the strap is also of corrosion-resistant material and snaps into the metal loop or similar ring device located on the butt end of the compressed air cylinder support boot or cup. The strap also contains a buckle that allows the user to shorten or lengthen the strap to meet his physical requirements or to suit his own personal preference. The pad means is adjustable along the length of the strap and provides a cushion to spread the load of the cylinder. Preferably the material of the compressed air cylinder boot is of rigid plastic or of a rubber type material sized to fit snugly over the lower end of the compressed air cylinder. The ring about the cup or boot is of stainless steel or aluminum and may be fastened around the entire outside circumference by suitable means such as that shown or by the use of rivets, screws, or similar fastening devices. Preferably the pivotal loop is provided of a similar material and provides for sufficient clearance so as to be accessible for attachment to the adjustable strap.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A carrying sling 12 for a generally cylindrically shaped scuba tank 14 of predetermined height having an upper rounded end zone with an axially projecting valve means 18 and a closed lower end 20 of predetermined diameter, said sling comprising, an end cup 22, said end cup having a cylindrical side wall sized to nest about the lower end of the tank and a floor 24 to underlay the tank end, said end cup including a radially extending portion 26, said floor comprised of an openwork having a plurality of radially extending portions and a central zone, a flexible strap 28 having an upper end 30 and a lower end 32 and of a length greater than the predetermined height of the tank, means 34 on the lower strap end to connect to the radially extending portion, and ring means 36 on the upper strap end sized for passage over the projecting valve means, whereby the lower end of the tank is adapted to be received in the end cup and the ring means are adapted to connect about the projecting valve means whereby the strap may be used as a carrying sling for the scuba tank.

2. The device as set forth in claim 1 wherein said end cup is of rigid plastic material.

3. The device as set forth in claim 1 wherein said end cup includes a ring and said radially extending portion extends from said ring.

4. The device as set forth in claim 3 wherein said radially extending portion comprises a generally U-shaped member 40 and pivot means 42 to connect said member to said ring.

5. The device as set forth in claim 1 wherein said strap is composed of a first and a second length 44 and 46 and adjustment means 48 for interconnecting the lengths.

6. The device as set forth in claim 1 wherein said flexible strap includes pad means 50 intermediate the upper and lower ends.

7. The device as set forth in claim 6 wherein said pad means comprises a longitudinally extending pad having a first and second axially spaced loop 52-54 and said strap extends through said loops whereby said pad is adjustably axially along the length of said strap.

8. The device as set forth in claim 1 wherein said means to connect to the radially extending portion comprises a hook means 56 on said lower end of said strap.

9. The device as set forth in claim 8 wherein said radially extending portion comprises pivot means interconnecting said radially extending portion and said ring of said end cap.

* * * * *